United States Patent [19]

Liepins et al.

[11] 4,143,636

[45] Mar. 13, 1979

[54] GUN WITH SAFETY LINK FOR FIRING MECHANISM THEREOF

[75] Inventors: Sigurds Liepins, Rushville; James W. Crane, Fairport, both of N.Y.

[73] Assignee: The Coleman Company, Inc., Wichita, Kans.

[21] Appl. No.: 814,897

[22] Filed: Jul. 12, 1977

[51] Int. Cl.[2] ..... F41B 11/06; F41C 17/08

[52] U.S. Cl. ..... 124/40; 42/70 F; 124/76

[58] Field of Search ..... 124/40, 74, 76; 42/66, 42/70 F

[56] References Cited

U.S. PATENT DOCUMENTS

| | | | |
|---|---|---|---|
| 566,393 | 8/1896 | Fyrberg | 42/66 |
| 875,469 | 12/1907 | Tambour | 42/66 |
| 933,188 | 9/1909 | Leggett | 42/66 |
| 3,119,384 | 1/1964 | Merz | 124/76 |
| 3,701,213 | 10/1972 | Lewis | 42/66 X |
| 3,988,848 | 11/1976 | Chatigny | 42/70 F |

*Primary Examiner*—Richard T. Stouffer

[57] ABSTRACT

A safety link assembly prevents discharge or firing of a gun unless the trigger is pulled. The assembly includes a hammer link pivotally connected to a link mounting member. The link mounting member is pivotally mounted on the same pivoting axis as the trigger, and a trigger-engaging portion on the link mounting member engages the trigger so that movement of the trigger pivots the link mounting member. The hammer of the gun is pivotally mounted on the gun for movement between cocked and fired positions. When the hammer is in its fired position, it is spaced from the firing mechanism of the gun. When the trigger is pulled, the link mounting member pivots with the trigger to move the safety link into position between the firing mechanism and the hammer so that when the trigger releases the hammer from its cocked position, the hammer will strike the safety link and force it against the firing mechanism to discharge the gun. Unless the trigger is pulled, the safety link will not be in position to be engaged by the hammer, and the hammer cannot fire the gun. When the trigger is released and the link mounting member returns toward its original position, the pivotable hammer link pivots on the mounting member out of engagement with the hammer.

7 Claims, 7 Drawing Figures

GUN WITH SAFETY LINK FOR FIRING MECHANISM THEREOF

BACKGROUND AND SUMMARY

This invention relates to a safety mechanism for guns, and, more particularly, to a safety mechanism which prevents a gun from being discharged unless the trigger is pulled.

A gun conventionally includes a hammer, a trigger for releasing the hammer from a cocked position, and a firing mechanism which is engageable by the hammer for firing the gun. If the firing mechanism is directly engageable by the hammer, it might be possible to fire the gun without pulling the trigger. For example, the gun could be dropped on its hammer which would cause the hammer to hit the firing mechanism hard enough to fire the gun. Alternatively, the hammer could be pulled toward its cocked position in which it is held by the sear mchanism but released before it reaches the cocked position. Even if the hammer does not reach its fully cocked position before it is released, it could strike the firing mechanism with sufficient force to fire the gun.

The invention prevents discharge of the gun when the trigger is in its relaxed or non-fire position. The hammer is not directly engageable with the firing mechanism and will not fire the gun unless a safety link is first interposed between the hammer and the firing mechanism. The safety link is movable into a firing position only by pulling the trigger. The trigger engages a steel pad on a pivotable mounting member for the safety link, and the trigger and the mounting member pivot together when the trigger is pulled. After the gun is fired and the trigger is released, the safety link can pivot on the mounting member so that it can move out of engagement with the hammer.

DESCRIPTION OF THE DRAWING

The invention will be explained in conjunction with an illustrative embodiment shown in the accompanying drawing, in which—

DESCRIPTION OF SPECIFIC EMBODIMENT

Figures 1, 4, 5, 6, 7:
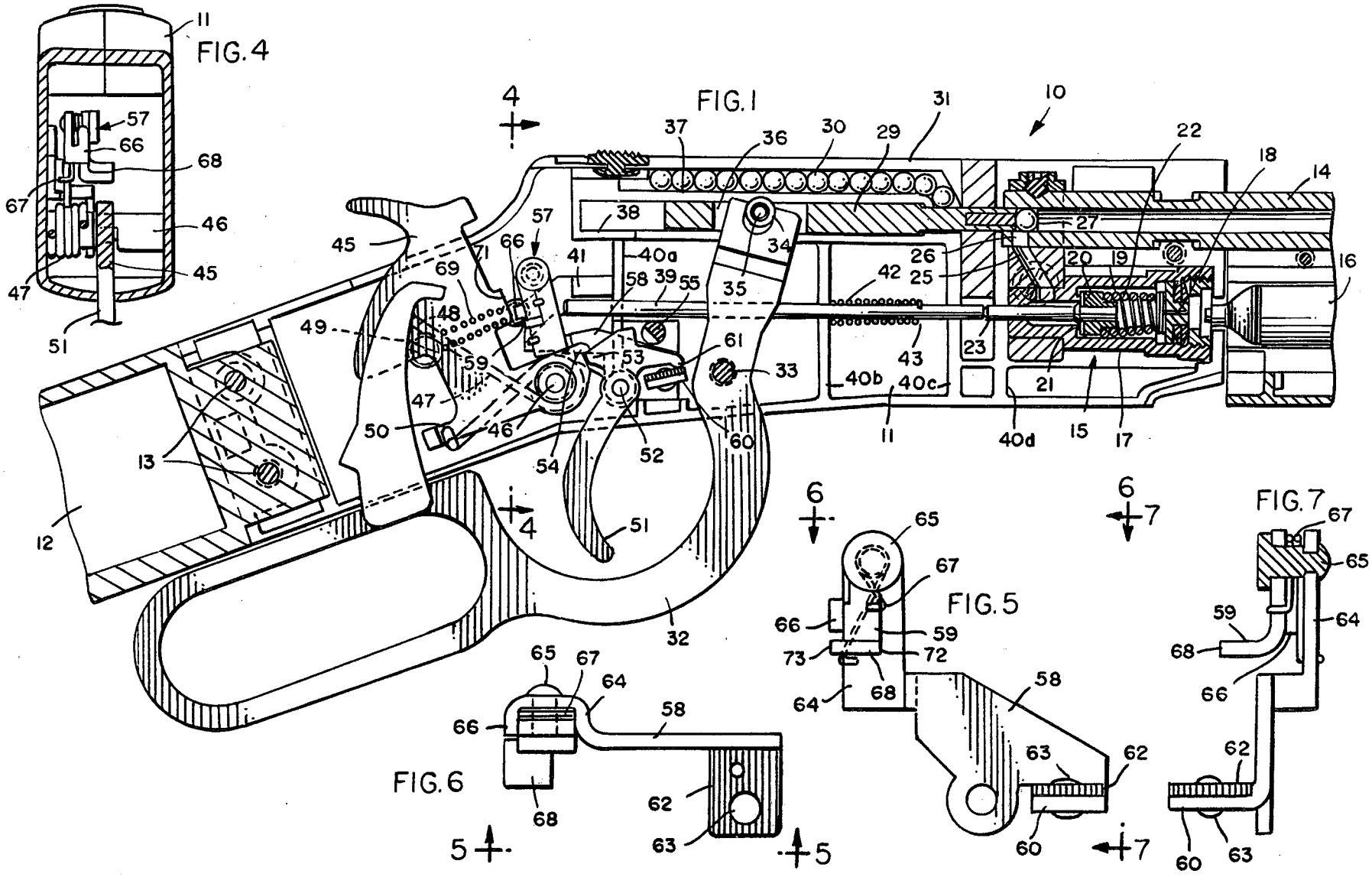
FIG. 1 is a fragmentary sectional view of a gun equipped with the inventive safety link assembly, the gun being shown in the cocked, ready-to-fire position.
FIG. 4 is a sectional view taken along the line 4—4 of FIG. 1.
FIG. 5 is an enlarged side elevational view of the safety link assembly.
FIG. 6 is a top plan view of the safety link assembly taken along the line 6—6 of FIG. 5.
FIG. 7 is a front elevational view of the safety link assembly taken along the line 7—7 of FIG. 5.

The numeral 10 designates generally a rifle comprising a frame or receiver 11 comprised of a pair of mating halves **11*a* and 11*b* (FIG. 4), a stock 12 secured to the receiver by screws 13, and a barrel 14**. The particular gun illustrated is a gas-operated BB and pellet rifle, but it will be understood that the invention can be used with other types of guns.

The gun includes a conventional valve assembly 15 which transmits $CO_2$ gas from a $CO_2$ cartridge 16 to the barrel. The valve assembly includes a valve body 17, a hollow piercing pin 18 for puncturing the cartridge, a gas chamber 19 in the valve body, and a resilient sealing ring 20 which is urged against a valve seat 21 to seal the chamber by a spring 22. The sealing ring is movable to the right to open the chamber by a valve stem 23.

When the valve is opened, pressurized $CO_2$ gas flows from the chamber 19 to the barrel through a passage 25 in the valve block and a port 26 in the barrel. A BB 27 is positioned slightly forwardly of the rear edge of the port by a bolt 29, and the $CO_2$ pressure propels the BB out of the barrel.

Additional BB's 30 are stored in a magazine or BB chamber 31 in the receiver, and the bolt 29 is reciprocable by a cocking lever 32 for loading the next BB into the barrel. The lever is pivotally mounted in the receiver by a screw 33 and engages a roller bearing 34 ensleeved on a pin 35 extending across a recess 36 in the bolt. Downward movement of the cocking lever moves the bolt rearwardly to permit the first BB in the magazine to fall into alignment with the barrel. Forward movement of the bolt then moves the BB into the barrel and positions it with respect to the port 26. The bolt is guided for sliding movement in the receiver by parallel walls 37 and 38 above and below the bolt, the wall 37 forming the bottom of the BB magazine.

The valve stem 23 is operated by a valve stem extension rod 39 which is slidably supported in openings in transverse walls **40*a*, 40*b*, 40*c*, and 40*d* of the receiver. The rear end of the extension rod extends slightly rearwardly beyond a locating pad or block 41 on the rear wall 40*a*, and the extension rod is biased against rearward movement by a spring 42 on the rod which engages the wall 40*b* and a stop washer 43**.

A hammer 45 is pivotally mounted in the receiver by a pin 46 and is biased to pivot in a clockwise direction toward the rear end of the extension rod by a torsion spring 47 (see also FIG. 4). One end 48 of the torsion spring abuts a boss 49 on the receiver, and the other end 50 of the torsion spring engages the lower edge of the hammer. The hammer is maintained in its cocked position illustrated in FIG. 1 by a trigger 51. The trigger is pivotally mounted on a pin 52 and includes a sear portion 53 which engages a sear portion 54 on the hammer. The trigger is prevented from pivoting clockwise from its FIG. 1 position by a safety pin 55 which is rotatably mounted in the receiver, and the engagement of the hammer and trigger sears maintains the hammer in its cocked position.

The hammer can be released by pulling the trigger rearwardly, i.e., pivoting the trigger clockwise until the trigger sear moves out of engagement with the hammer sear. The hammer torsion spring 47 will then pivot the hammer clockwise toward the valve stem extension rod. However, the hammer cannot pivot far enough to engage the extension rod. Rather, the hammer strikes a safety link assembly 57 which in turn moves the extension rod to the right to open the $CO_2$ valve.

The safety link assembly 57 (see also FIGS. 5–7) includes an interlock or link mounting member 58 and a safety link or hammer link 59 which is pivotally mounted on the link mounting member. The link mounting member is pivotally mounted on the same pin 52 which mounts the trigger, and the mounting member includes an axially extending projection 60 which is engaged by a lever portion 61 on the trigger. A steel pad 62 is mounted on the projection by a rivet 63. An upwardly extending link support portion 64 is laterally offset from the remainder of the link mounting member (FIG. 7), and the link 59 is pivotally connected to the support portion by a rivet 65. The link is biased clockwise against a lug 66 on the link support portion 64 by a torsion spring 67, and the link includes a lower laterally extending hammer-engaging portion 68.

A trigger spring 69 extends between the screw 49 and the lug 66 on the link assembly and urges the link assembly to pivot counterclockwise about the pivot pin 52. Since the pad 62 of the link assembly engages the trigger, the trigger is also biased in a counterclockwise direction.

When the trigger is pulled rearwardly against the force of the trigger spring, the link mounting member and the safety link pivot clockwise toward the end of the valve stem extension rod until the link mounting member engages the locating pad 41 on the left half of the receiver. The link mounting member will contact the locating pad simultaneously with or just prior to the time at which the sears of the trigger and hammer disengage.

When the link mounting member engages the locating pad 41, the laterally extending hammer-engaging portion 68 of the safety link will be positioned just rearwardly of the valve stem extension rod 39. When the sears disengage, the hammer will be snapped forwardly by the hammer spring, and a striking projection 71 on the hammer will strike the bottom portion 68 of the link, causing the link to pivot counterclockwise about its pivot 65 and push the extension rod to open the $CO_2$ valve. The energy stored in the cocked hammer spring is sufficient to open the $CO_2$ valve and release an appropriate amount of pressurized $CO_2$ to discharge the BB, after which the valve spring 19 will close the valve.

Figure 2:
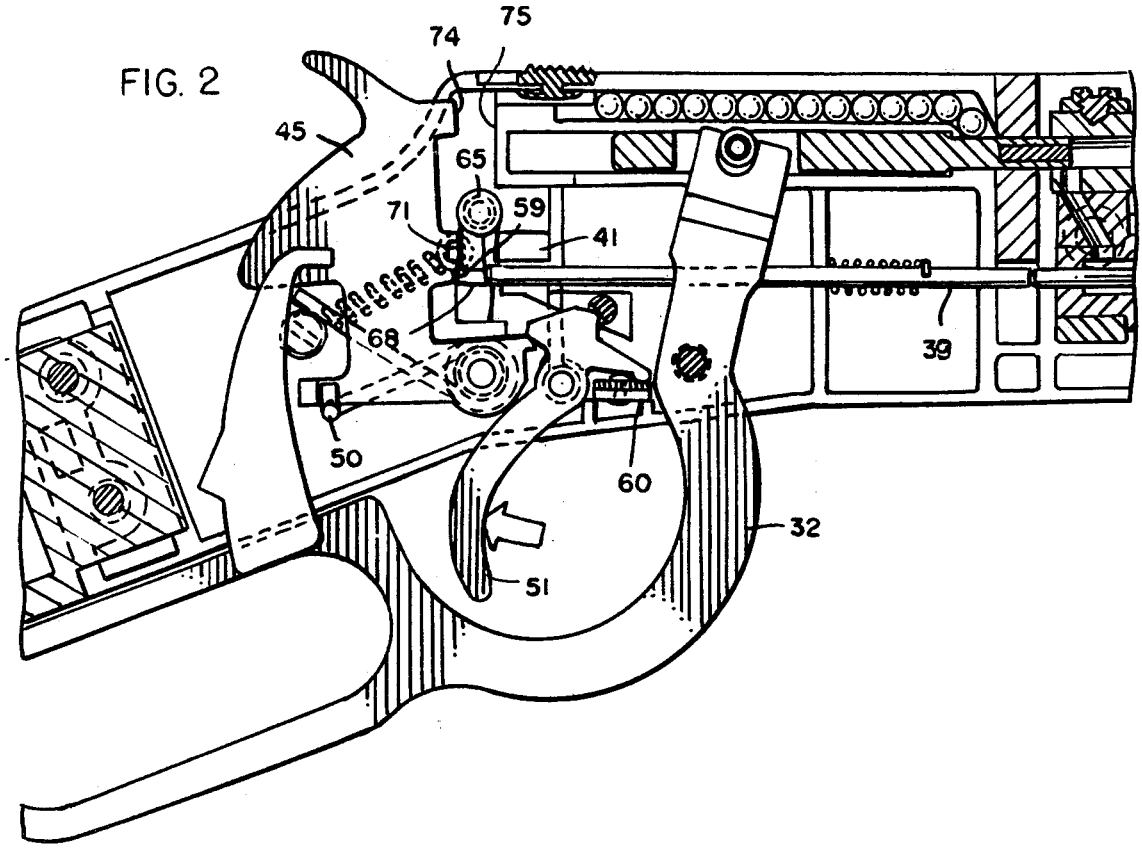
FIG. 2 is a view similar to FIG. 1 showing the gun in the fired position.

The gun is shown in its fired position in FIG. 2. The bottom portion 68 of the safety link is aligned axially with the extension rod 38, and the striking edge 71 of the hammer has engaged the rear surface of the link portion 68. The bottom portion 68 of the link is rectangular in cross section, and the long dimension of the link extends in alignment with the extension rod and the striking edge of the hammer. A narrow front flat surface 72 (FIG. 5) of the link portion 68 engages the flat extension rod, and a narrow rear flat surface 73 is engaged by the hammer.

Figure 3:
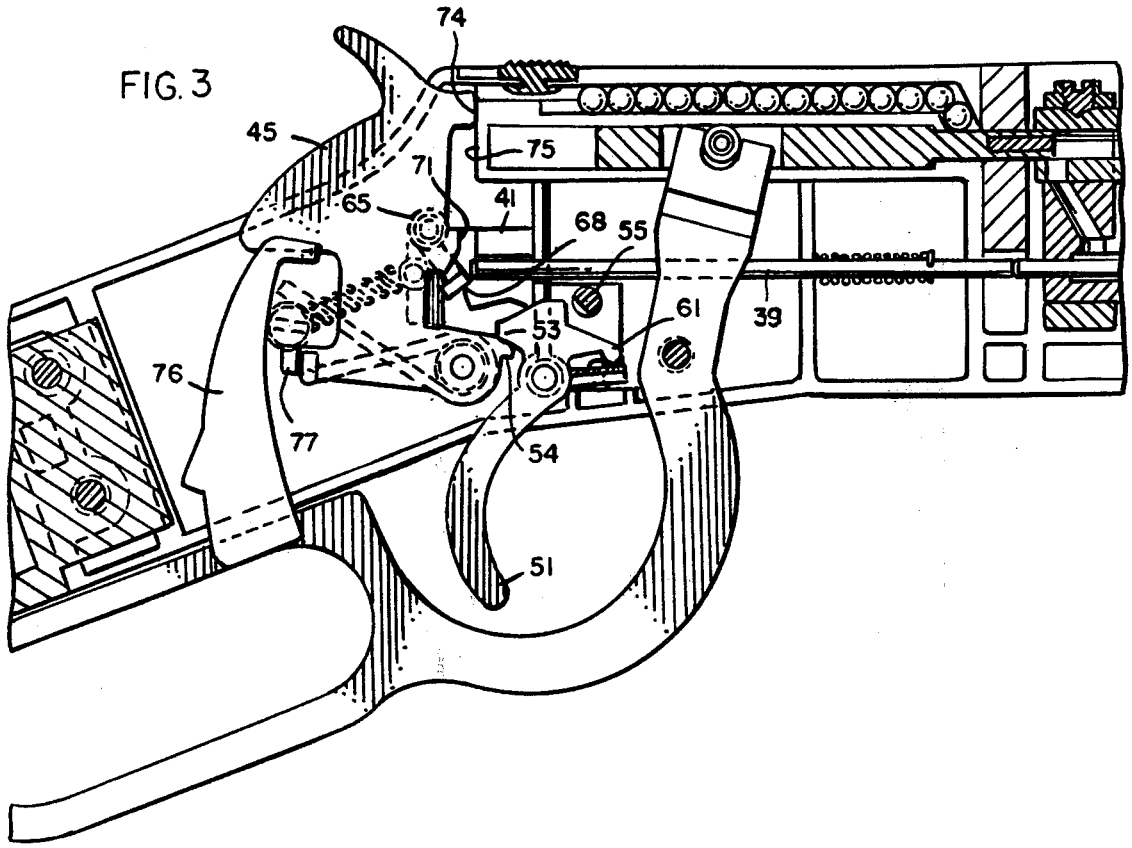
FIG. 3 is a view similar to FIGS. 1 and 2 showing the trigger released from the firing position.

FIG. 3 shows the gun after the gun has been fired and the trigger has been released. The trigger return spring 69 pivots the link mounting member and the trigger counterclockwise about the common pivot 52. This pivoting movement of the link mounting member swings the pivot point 65 of the safety link rearwardly and downwardly. Since the safety link is engaged by the striking edge of the hammer, the safety link pivots counterclockwise on the pin 65 relative to the link mounting member as the mounting member pivots, and the long dimension of the hammer-engaging portion 68 of the link moves out of alignment with the striking edge of the hammer and the extension rod. The hammer is moved forward slightly by the hammer spring as the safety link pivots until an upper projection 74 on the hammer engages the rear wall 75 of the BB magazine.

As can be seen in FIG. 3, the striking edge 71 of the hammer is spaced rearwardly of the extension rod and is prevented from hitting the extension rod by the engagement of the hammer with the magazine. The short dimension of the hammer-engaging portion 68 of the safety link is less than the space between the striking edge of the hammer and the extension rod, and the hammer-engaging portion 68 is below the striking edge. Accordingly, even if the gun is dropped on the hammer or if the hammer is pulled rearwardly and released, the hammer cannot engage the extension rod and the gun will not fire. The gun will fire only when the safety link is positioned between the extension rod and the hammer, and this occurs only when the trigger is pulled.

The gun is shown in its fired or rest position in FIG. 3. The gun is cocked by pivoting the cocking lever 32 downwardly. A hook 76 extends upwardly from the lever and is engageable with a laterally extending projection 77 on the rear of the hammer as the hammer moves downwardly. The hook rotates the hammer counterclockwise against the bias of the hammer spring 50 until the hammer sear 54 passes over the trigger sear 53 and the hammer is latched in its cocked position shown in FIG. 1. As the hammer pivots away from the safety link, the safety link torsion spring 67 pivots the safety link clockwise about the rivet 65 until the safety link engages the lug 66 as shown in FIG. 5. The cocking lever is then returned to its FIG. 1 position, and the gun is ready to fire. However, unless the trigger is pulled, the safety link will not be in position between the extension rod and the hammer, and the gun will not fire.

The particular gun illustrated and described is a gas powered gun, and the firing mechanism comprises the extension rod 39 and the $CO_2$ valve assembly. However, it will be understood that the invention can be used with other guns. For example, the gun can be a firearm in which the firing mechanism includes a firing pin which strikes a powder cartridge.

While in the foregoing specification a detailed description of a specific embodiment of the invention was set forth for the purpose of illustration, it is to be understood that many of the details hereingiven may be varied considerably by those skilled in the art without departing from the spirit and scope of the invention.

We claim:

1. In a gun having a frame, a hammer, a trigger, and firing means operable by movement of the hammer for firing the gun, a shaft mounted on the frame, the trigger being pivotally mounted on the shaft for pivoting movement between rest and fired positions, the hammer being pivotally mounted on the frame for movement between cocked and fired positions, the gun including a hammer spring for biasing the hammer toward its fired position and sear means for releasing the hammer from its cocked position when the trigger moves to its fired position, an improved safety link assembly for preventing firing of the gun unless the trigger is pulled comprising a link mounting member pivotally mounted on the shaft independently of the trigger and having a trigger-engaging portion engageable with the trigger as the trigger pivots from its rest position to its fired position for pivoting the link mounting member on the shaft, and a hammer link mounted on the link mounting member, the hammer and the firing means being spaced apart when the hammer is in its fired position, the hammer link being pivotable with the link mounting member into the space between the hammer and the firing means as the trigger moves to its fired position and being engageable by the hammer as the hammer moves from its cocked position to its fired position whereby the link is forced against the firing means to fire the gun.

2. The structure of claim 1 in which the hammer link is pivotally mounted on the link mounting member, and spring means biasing the link to a firing position in which it is in position to be engaged by the hammer when the hammer is released, the link being pivotable on the link mounting member away from its firing position against the bias of the spring means when the trigger is released from its fired position whereby the link is moved out of engagement with the hammer.

3. The structure of claim 1 including a trigger spring biasing the link mounting member to a rest position, the trigger-engaging portion of the link mounting member maintaining the trigger in its rest position when the link mounting member is in its rest position, the link mounting member and the trigger being urged to return to their rest positions by the trigger spring when the trigger has been moved to its fired position to fire the gun whereby the hammer link is moved out of engagement with the hammer when the trigger is released.

4. The structure of claim 3 in which the hammer link is pivotally mounted on the link mounting member, and spring means biasing the link to a firing position in which it is in position to be engaged by the hammer when the hammer is released, the link being pivotable on the link mounting member away from its firing position against the bias of the spring means when the trigger is released from its fired position whereby the link is moved out of engagement with the hammer.

5. The structure of claim 3 in which the hammer link is pivotally mounted on the link mounting member for pivoting movement about an axis which extends parallel to the pivoting axes of the hammer and the link mounting member and includes a first portion which extends perpendicularly to said axis and a hammer-engaging portion which extends parallel to but offset from said axis, the hammer-engaging portion being generally rectangular and having a long dimension which extends between the hammer and the firing means when the trigger and the hammer are in their firing positions and a short dimension which is less than the space between the hammer and the firing means, the hammer link being pivotable on the link mounting member as the trigger moves from its fired position toward its rest position whereby the long dimension of the hammer-engaging portion of the link pivots out of alignment with the hammer and the firing means.

6. The structure of claim 1 in which the hammer link is pivotally mounted on the link mounting member for pivoting movement about an axis which extends parallel to the pivoting axes of the hammer and the link mounting member and includes a first portion which extends perpendicularly to said axis and a hammer-engaging portion which extends parallel to but offset from said axis, the hammer-engaging portion being generally rectangular and having a long dimension which extends between the hammer and the firing means when the trigger and the hammer are in their firing positions and a short dimension which is less than the space between the hammer and the firing means, the hammer link being pivotable on the link mounting member as the trigger moves from its fired position toward its rest position whereby the long dimension of the hammer-engaging portion of the link pivots out of alignment with the hammer and the firing means.

7. The structure of claim 6 in which the hammer link is pivotally mounted on the link mounting member, and spring means biasing the link to a firing position in which it is in position to be engaged by the hammer when the hammer is released, the link being pivotable on the link mounting member away from its firing position against the bias of the spring means when the trigger is released from its fired position whereby the link is moved out of engagement with the hammer.

* * * * *